US011578434B2

(12) United States Patent
Buchmüller

(10) Patent No.: US 11,578,434 B2
(45) Date of Patent: Feb. 14, 2023

(54) NOZZLE AND METHOD FOR MANUFACTURING KNOTTED YARN

(71) Applicant: HEBERLEIN AG, Wattwil (CH)

(72) Inventor: Patrick Buchmüller, Krummenau (CH)

(73) Assignee: HEBERLEIN AG, Wattwil (CH)

( * ) Notice: Subject to any disclaimer, the term of this patent is extended or adjusted under 35 U.S.C. 154(b) by 270 days.

(21) Appl. No.: 16/783,509

(22) Filed: Feb. 6, 2020

(65) Prior Publication Data

US 2020/0248340 A1 Aug. 6, 2020

Related U.S. Application Data

(62) Division of application No. 15/100,679, filed as application No. PCT/EP2014/073046 on Oct. 28, 2014, now Pat. No. 10,597,800.

(30) Foreign Application Priority Data

Dec. 19, 2013 (EP) ..... 13198527

(51) Int. Cl.

| | |
|---|---|
| ***D02G 1/16*** | (2006.01) |
| ***D02G 3/34*** | (2006.01) |
| ***D02J 1/08*** | (2006.01) |

(52) U.S. Cl.

CPC ..... *D02G 1/161* (2013.01); *D02G 1/162* (2013.01); *D02G 3/34* (2013.01); *D02J 1/08* (2013.01)

(58) Field of Classification Search

CPC .. D02J 1/08; D02G 1/16; D02G 1/161; D02G 1/162; D02G 3/34

See application file for complete search history.

(56) References Cited

U.S. PATENT DOCUMENTS 3,389,444 A * 6/1968 Fletcher ..... D02J 1/08 28/274
3,745,617 A * 7/1973 Smith, Jr. ..... D02G 1/161 28/273

(Continued)

FOREIGN PATENT DOCUMENTS

CH 692 622 A5 8/2002
DE 20 38 403 A1 2/1972

(Continued)

OTHER PUBLICATIONS

"Directed" The Free Dictionary by Farlex. Web. https://www.thefreedictionary.com/directed.*

(Continued)

*Primary Examiner* — Jillian K Pierorazio
(74) *Attorney, Agent, or Firm* — Finch & Maloney PLLC

(57) ABSTRACT

Nozzle (1) for manufacturing knotted yarn (11), having a yarn duct (2) in which knots are producible with the aid of air entanglement. The nozzle includes at least one air bore (3) having a longitudinal axis (A), which merges with the yarn duct (2) in a merging opening (4). Air is introducible into the yarn duct (2) through the air bore. The longitudinal axis (A) of the air bore (3) is disposed at an angle of less than 90°, preferably 65-85°, particularly preferably 78° in relation to a conveying direction (B) of the knotted yarn (11). A baffle face (5) is configured on the opposite side of the merging opening (4) of the air bore (3) in the yarn duct (2), so as to be substantially perpendicular in relation to the longitudinal axis (A) of the air bore (3).

21 Claims, 9 Drawing Sheets

(56) References Cited

U.S. PATENT DOCUMENTS 4,064,686 A * 12/1977 Whitted ..... D02G 1/162 57/208
4,184,316 A 1/1980 Griset, Jr.
4,217,323 A * 8/1980 Foster ..... D02J 13/00 264/235
4,223,520 A * 9/1980 Whitted ..... D02G 1/162 28/276
4,430,780 A * 2/1984 Sear ..... D02J 1/08 28/272
4,679,284 A * 7/1987 Naylor ..... D02J 1/08 28/272
4,729,151 A * 3/1988 Runyon ..... D02J 1/08 28/276
5,010,631 A 4/1991 Ritter
5,326,009 A * 7/1994 Kobayashi ..... D04H 3/03 226/97.4
5,950,290 A * 9/1999 Sear ..... D02G 1/161 28/272
5,964,015 A * 10/1999 Sear ..... D02J 1/08 28/274
5,970,593 A * 10/1999 Sear ..... D02G 1/161 28/272
6,052,878 A * 4/2000 Allred ..... D02G 1/161 28/252
6,088,892 A * 7/2000 Bertsch ..... D02G 1/161 28/273
6,438,812 B1 8/2002 Jansen
6,609,278 B1 * 8/2003 Ritter ..... D02G 1/162 28/271
6,834,417 B1 * 12/2004 Buchmuller ..... D02G 1/161 28/271
7,127,785 B2 * 10/2006 Sear ..... D02G 1/161 28/271
7,353,575 B2 4/2008 Buchmüller
7,568,266 B2 8/2009 Simmen
2005/0011061 A1 * 1/2005 Buchmuller ..... D02J 1/08 28/252
2007/0107410 A1 * 5/2007 Bertsch ..... D02G 1/161 57/350
2007/0226970 A1 * 10/2007 Pourdeyhimi ..... D04H 1/492 28/100
2009/0031693 A1 * 2/2009 Simmen ..... D02G 1/16 57/350
2011/0277285 A1 * 11/2011 Simmen ..... D02G 1/161 28/271

FOREIGN PATENT DOCUMENTS

DE 41 13 927 A1 11/1992
DE 10 2006 009 139 A1 8/2007
DE 10 2012 003 410 A1 8/2013
EP 0 190 476 A1 8/1986
EP 1 092 796 A1 4/2001
JP 2001-248031 A 9/2001
JP 2008-533324 A 8/2008
JP 2013-227711 A 11/2013
WO 99/45185 A1 9/1999
WO 00/52240 A1 9/2000
WO 03/029539 A1 4/2003
WO 2006/099763 A1 9/2006

OTHER PUBLICATIONS

"Region" Merriam-Webster. Web. https://www.merriam-webster.com/dictionary/region.*
International Search Report Corresponding to PCT/EP2014/073046 dated Apr. 8, 2015.
Written Opinion Corresponding to PCT/EP2014/073046 dated Apr. 8, 2015.
Japanese Office Action Corresponding to 2016-541283 dated Oct. 4, 2018.

* cited by examiner

NOZZLE AND METHOD FOR MANUFACTURING KNOTTED YARN

The invention relates to a nozzle having a yarn duct, and to a method for manufacturing knotted yarn in the yarn duct, and to the use of the nozzle for manufacturing knotted yarn, having the features of the preamble of the independent patent claims.

Individual filaments of a smooth or texturized filament yarn are knotted with the aid of air entanglement, so as to form knotted yarn. The air entanglement process here preferably takes place in a nozzle. In a yarn duct of the nozzle, air is applied transversely to the running direction onto the filaments. On account of the partial flow turbulences, the filaments within the yarn duct are induced to rotate in opposite directions. Here, knotted yarn is created on account of interlocked filaments, which are referred to as knots.

In DE 41 13 927, a nozzle having a main duct for the introduction of entanglement air, and two support ducts which lie opposite the main duct is described. The support ducts introduce air which enshrouds the yarn into the nozzle. With the aid of the air of the support ducts, a neat degree of entanglement is to be achieved. However, a construction having three air ducts is complex/expensive. Moreover, using a construction of DE 41 13 927, only uniformity is increased, but an increase of the number of knots is not achieved. Moreover, a comparatively high amount of compressed air and thus energy is required for a formation of knotted yarn, using three air ducts.

In WO 03/029539, a nozzle in which primary air is introduced perpendicularly into the yarn duct, and secondary air is introduced via an auxiliary bore having a conveying effect, is described. The construction having two air bores is complex. Moreover, a comparatively high amount of compressed air and thus energy is required for the formation of knotted yarn, using two air ducts.

It is, therefore, the object of the present invention to avoid the disadvantages of the known, in particular to provide a nozzle, a method and use, in which an efficient and reliable formation of knots is achieved, using a simple construction.

These objects are achieved by nozzles, methods, and uses according to the independent claims.

In the following, the invention is explained by means of nozzles having bores for introducing air. Instead of air, other gaseous fluids may also be used for entanglement.

Moreover, the term filaments is used. This term is used both for individual filaments, for mono yarn, and also for assembled filaments, what are referred to as threads or yarn. The filaments here may be texturized or non-texturized, i.e. flat. Yarn made from flat filaments is described as flat yarn.

According to the invention, a nozzle for manufacturing knotted yarn has a yarn duct in which knots are producible with the aid of air entanglement. At least one air bore having a longitudinal axis merges with the yarn duct in a merging opening. Air is introducible into the yarn duct through the air bore. The longitudinal axis of the air bore is disposed at an angle of less than 90° in relation to the conveying direction of the knotted yarn, wherein the angle of less than 90° between the longitudinal axis and the conveying direction is upstream. A baffle face is disposed on the opposite side of the merging opening of the air bore. The baffle face, according to the invention, is configured so as to be substantially perpendicular in relation to the longitudinal axis of the air bore.

In the spinning process, individual filaments are preferably conveyed through the nozzle at a process speed of approximately 2000-6000 m/min, in the false-twist process and drawing process preferably at approximately 300-1200 m/min. The air from the air bore is preferably applied to the filaments at approximately 1 to 6 bar, in particular 4 bar.

On account of the inclination of the longitudinal axis of less than 90° in relation to the conveying direction, the air is obliquely introduced into the yarn duct. On account thereof, a positive flow of mass of the air in the conveying direction results. The filaments are conveyed by way of the flow of mass of the air in the conveying direction. Moreover, a drop in thread tension in the nozzle is prevented in the case of irregularities in the process, such as, for example, in the case of a package change.

The air impacts the baffle face in a substantially perpendicular manner. On account of the impact, the air is configured so as to form two opposing turbulences. On account of the opposing manner of the turbulences, part of the filaments are moved in one direction and the other part in the opposite direction. It has been demonstrated that a perpendicular impact on the baffle face has the consequence of a uniform and intensive entanglement. As a result of this uniform and intensive entanglement, knotted yarn having consistent knots, both in terms of the spacing of the knots in the yarn and also in terms of the thickness of the knots and the number of knots/metre is created. Consistent knots, or the maximum open length, i.e. the maximum length of non-entangled yarn between the knots, is a quality feature of knotted yarn.

Substantially perpendicular in relation to the longitudinal axis of the air bore means in the present case that the baffle face, in the region lying opposite the merging opening, is at least in part configured so as to be at an angle of about 85° to 95° in relation to the longitudinal axis. A baffle face which is configured so as not to be entirely planar but, for example, is slightly undulated or nubby, in this context is also described as being substantially perpendicular in relation to the longitudinal axis of the air bore, on the condition that the basic orientation of the baffle face is configured so as to be substantially perpendicular in relation to the longitudinal axis of the air bore.

On account of the implementation having only one air bore, the air consumption for the same knotting quality is reduced in relation to nozzles having a plurality of air bores. The reduction of the air consumption leads to a reduction of the energy consumption and, consequently, the running costs.

Alternatively, it is also possible for a plurality of air bores to be applied. In this manner, the air bores may be disposed in one plane about the yarn duct, for example.

Preferably, the yarn duct, in the region of the entry opening, is constricted in relation to a cross section of the yarn duct in the region of the merging opening of the air bore. The constriction is preferably configured such that the height of the yarn duct at the entry opening corresponds to between 10% and 70%, preferably 40% of the height of the yarn duct in the region of the merging opening. The constriction may take place directly at the entry opening.

Alternatively, in the region of the entry opening, the yarn duct is initially widened in relation to the height of the yarn duct in the region of the merging opening of the air bore, before the above-described constriction takes place. The prior widening is configured such that the height of the yarn duct in the region of the widening is widened by preferably 5 to 55%, particularly preferably 30%, in relation to the height between the merging opening and the baffle face.

At the constriction, the filaments may be deflected by the air which is introduced via the merging opening around an edge of the constriction. On account of the deflection, the filaments are transformed from a round shape to a tape shape. The tape shape facilitates entanglement, since the former offers a larger contact surface for the air turbulences. Further details of the deflection and deformation of the filaments may be obtained from a following embodiment of the invention.

Additionally or alternatively to the above-described constrictions in the region of the entry opening, an exit opening of the yarn duct is also widened in relation to a cross section of the yarn duct in the region of the merging opening of the air bore. On account of a construction of this type, a larger net amount of air dissipates via the exit opening than via the entry opening.

On account of an embodiment having a constriction in the region of the entry opening and/or a widening of the exit opening, the exit opening has a larger diameter than the entry opening. This may result in a back pressure in the vicinity of the entry opening. A net outflow of air takes place via the exit opening. On account of the flow of air in the exit direction, conveying of the yarn is additionally supported. On account thereof, maintaining the conveyance and the tension in the yarn are further improved. On account thereof, the tension of the filaments is kept at a substantially constant rate in the case of irregularities in the process.

A constriction in the region of the entry opening, preferably on the opposite side of the merging opening of the air bore, moreover has a stabilizing effect on the filaments. This means that the filaments oscillate less in the lateral direction and thus are conveyed in a consistently more uniform manner in the centre of the yarn duct. This ensures a uniform quality of the knots and thus of the knotted yarn over time.

Furthermore, the turbulences in the entanglement air lose their intensity as the distance from the merging opening of the air supply increases. Moreover, one of the turbulences running in opposite directions is alternatingly configured so as to be stronger or weaker than the other. In this case, reference is made to pulsating turbulences. On account of a widening of the exit opening, the turbulences additionally lose force and are guided away from the filaments. These dissipated turbulences in the exit region do not substantially influence the filaments. Accordingly, the filaments remain in a stable, pacified state in the centre of the yarn duct. On account thereof, irregularities in the knotted yarn and inferior quality resulting therefrom are prevented.

Alternatively, the entry and/or exit opening are/is not constricted or widened, respectively, in relation to the diameter of the yarn duct in the region of the merging opening.

According to a further aspect of the invention, a nozzle for manufacturing knotted yarn has, the nozzle in turn has a yarn duct in which knots are producible with the aid of air entanglement. At least one air bore having a longitudinal axis merges with the yarn duct in a merging opening. Air is introducible into the yarn duct through the air bore. The longitudinal axis of the air bore is disposed at an angle of 90° in relation to the conveying direction of the knotted yarn. In the region of the entry opening, the yarn duct is constricted in relation to a cross section of the yarn duct in the region of the merging opening of the air bore. Additionally or alternatively, an exit opening of the yarn duct is widened in relation to a cross section of the yarn duct in the region of the merging opening of the air bore. On account of a construction of this type, more air dissipates via the exit opening than via the entry opening.

The resulting advantages of the constriction in the region of the entry opening and/or of the widened exit opening in the present nozzle are identical to the advantages of the already described nozzle having a constriction in the region of the entry opening and/or widened exit opening.

It is preferable here for the baffle face to be configured so as to be substantially perpendicular in relation to the longitudinal axis of the air bore. On account thereof, the air impacts the baffle face in a substantially perpendicular manner. On account of the perpendicular position of the baffle face in relation to the longitudinal axis of the air bore, the same advantages in turn result as in the case of the preceding embodiment having a perpendicular baffle face.

Furthermore, the already described criteria for the assessment of a perpendicular position are to be applied. Alternatively, the baffle face may also be configured so as to be inclined in relation to the longitudinal axis.

A nozzle of the embodiments described here is preferably configured so as to be in two parts, as a nozzle plate and a cover plate, which are releasably connectable to one another.

The plate which displays the merging opening of the air bore is described as the nozzle plate. Consequently, the cover plate is the plate opposite the yarn duct and preferably displays the baffle face.

The nozzle and cover plates can be released from one another. In the case of plates which have been released from one another, the yarn duct is readily accessible, in order to resolve complications or to carry out cleaning work, for example.

The plates are connected to one another by way of known connection elements, such as screws, for example. The plates are preferably held together with a connection device as described in the application WO 99/45185.

Alternatively, the nozzle may also be configured so as to be in one piece. For the sake of simplicity, reference here in turn is made to a cover and a nozzle plate, despite these being, strictly speaking, sides of the yarn duct and not individual plates.

The baffle face, in the conveying direction, preferably has a length of 2-4 times a diameter of the air bore, preferably 4-6 mm.

The diameter of the air bore is the diameter of the cross section and is, therefore, measured perpendicularly to the longitudinal axis of the air bore.

A length of the baffle face in the conveying direction of 2-4 times the diameter of the air bore ensures uniform air entanglement. The length of the baffle face is kept as short as possible. The baffle face may be at an angle in relation to a surface of the cover plate. On the one hand, the baffle face itself here may compromise conveying of the filaments, on the other hand, additional turbulences may be created which compromise conveying of the filaments. On account of a configuration of the baffle face with a length of 2-4 times the diameter of the air bore, which preferably corresponds to 4-6 mm, uniform air entanglement is ensured and simultaneously conveying of the filaments is compromised as little as possible.

Of course, it is also conceivable for the baffle face to be configured so as to be shorter or longer. However, since in this case compromises either in the quality of the knotted yarn or in conveying are created, a length of 2-4 times the diameter is preferable.

In the case of embodiments which display a constriction in the region of the entry opening and/or a widening of the exit opening, the constriction and/or the widening in the region of the entry opening/exit opening is preferably formed by a surface profile of the cover plate of the yarn duct.

The surface of the cover plate, therefore, at least in the case of one of the two openings, is configured so as to be at an angle to the conveying direction.

The constriction here may take place by an inclination of the surface in relation to an interior of the yarn duct across a certain distance. Here, the inclination is preferably uniform, therefore at an identical angle across a length of the inclination. The angle is preferably 1-7°, particularly preferably 4°.

Alternatively, the constriction may be established by a surface on the entry opening, which runs substantially perpendicularly in relation to the conveying direction, such that only the entry opening per se is constricted. The yarn duct here already has a diameter directly after the entry opening, which corresponds to about the diameter in the region of the merging opening.

This constriction here may simultaneously serve as a step for deflecting yarn, as per a functional mode which is described further below.

The widening is achieved by raising the cover plate in relation to the interior of the yarn duct. The rise is preferably uniform, thus having an identical angle across a length of the rise. Instead of a single angle, the surface may also be configured so as to be curved in a convex manner in relation to the interior of the yarn duct. On account thereof, a Coandĕ effect is created, on account of which the air stream is guided away from the yarn along the surface. The curvature here is configured such that the air is guided along the surface for as long a stretch as possible.

However, in the region of the entry opening and of the exit opening, the surface of the nozzle plate preferably runs substantially linearly and parallel to the conveying direction, i.e. substantially without an angle. The surface of the nozzle plate may also display a slight curvature.

A plate without an angled surface can be manufactured more easily and more cost-effectively than a plate which displays an angle in the surface. A nozzle in which only the surface profile of the cover plate leads to the constriction and/or the widening can thus be more cost-effectively produced than a nozzle in which the surface profile of both plates leads to the constriction and/or the widening.

In the case of an alternative preferred embodiment of nozzles which display a constriction in the region of the entry opening and/or a widening of the exit opening, the constriction and/or the widening is formed in the region of the entry opening/exit opening by a surface profile of a cover plate and of a nozzle plate.

Here, surfaces of both plates display an angle at least in the case of one of the two openings.

The constriction may be established either by an inclination of the two plates in relation to the interior of the yarn duct or by a perpendicular profile of the two plates in relation to the conveying direction at the entry opening. In the case of inclinations of the plates in relation to the interior of the yarn duct, said inclinations are preferably configured so as to be uniform, thus having an identical angle across lengths of the inclinations.

The widening is achieved by raising the nozzle plate and cover plate in relation to the interior of the yarn duct. The rises are preferably uniform, thus having an identical angle across lengths of the rises.

The advantage of this solution lies in that the constriction and/or widening is configured in a more uniform manner, such that the turbulences are guided away even better from the filaments. Depending on the type of the filaments, the conveying speed, and other parameters, such as, for example, the interior pressure of the yarn duct, this embodiment of a configuration having a linear surface profile of the nozzle plate is preferable.

Either a linear surface profile or else a surface which is curved in a convex manner as per the interior of the yarn duct are preferred. The surface here serves as a Coandă element, such that the irregular/pulsating turbulences of the air run along the surface. On account thereof, the exiting yarn is not moved out of the centre of the yarn duct.

A yet further aspect of the invention relates to a nozzle for manufacturing knotted yarn, having a yarn duct in which knots are producible with the aid of air entanglement. At least one air bore having a longitudinal axis merges with the yarn duct in a merging opening. Air is introducible into the yarn duct through the air bore. Between an entry opening of the yarn duct and the merging opening of the air bore, on a side of the yarn duct which is opposite the air bore, a step, preferably an oblique step, is configured. The step leads away from the merging opening in the conveying direction, such that yarn is deflected around an edge of the step.

The nozzle configuration having a step is combinable with the various described embodiments of nozzles.

A step in which the step height or increase in height, respectively, does not run perpendicularly to the tread, but in an oblique manner, thus at an angle between 0° and 90°, is described as an oblique step.

On account of the air of the air bore, the filaments substantially run along the cover plate. At the step, the filaments are deflected by the air, such that the filaments, in the conveying direction, are at least in part guided away from the merging opening. On account of the deflection at the step, preferably at an edge of the step, the filaments are transformed from a round shape to a tape shape or a shape similar to that of a tape. On account of the flatter shape, the filaments offer a larger contact surface for the entanglement air. On account thereof, the filaments are entangled in a more uniform manner, which increases the number and uniformity of the knots and thus the quality of the knotted yarn.

Preferably, the cross section of the yarn duct at the end of the step, in the conveying direction of the knotted yarn, is larger than the cross section of the yarn duct at the commencement of the step.

This is the case when the step is configured as an oblique step. Here, the cross section of the yarn duct is preferably enlarged in a uniform manner. A uniform enlargement largely prevents the undesired turbulences, which negatively influence conveying of the filaments, for example, from arising.

Alternatively, the step is configured as a protrusion which is radially oriented in an inward manner. The filaments here are deflected on the protrusion and thereby flattened.

The step is preferably configured in the region of the entry opening of the yarn duct.

In the case of an oblique step, the entry opening may represent the commencement of the step. Alternatively, the step may be disposed so as to be offset in the conveying direction.

The protrusion may be configured directly on the entry opening. The entry opening here is constricted in relation to the diameter of the yarn duct in the region of the merging opening. Additionally to the flattening of the filaments, this entails the already described advantages of the constriction of an entry opening.

Alternatively, the yarn duct and thus the conveying direction of the yarn in the yarn duct may be angled in relation to an insertion direction of the yarn. Here, preferably at least the cover plate, in relation to the insertion direction, is disposed at an angle of less than 180°, wherein the angle of an outer wall of the cover plate and of the insertion direction is measured. The nozzle plate here is preferably configured so as to be parallel to the cover plate. The cover plate, however, may also be parallel in relation to the insertion direction or at another angle in relation to the insertion direction. On account of the angle of the cover plate in relation to the insertion direction, the filaments, when entering into the yarn duct, are deflected around an edge of the entry opening. Here, a transformation of the filaments from a round shape to a flattened shape takes place, which entails the aforementioned advantages.

The oblique step here is preferably configured at an angle of 2-6°, particularly preferably 4°, in relation to the conveying direction.

The described nozzles preferably display an asymmetrical cross section. Substantially U-shaped, semi-circular, T-shaped, or V-shaped cross sections are particularly preferred.

Here, the nozzle plate forms the portion which converges in a pointed or round manner, respectively, and the cover plate forms the substantially linear portion in relation to the converging portion.

Alternatively, symmetrical cross sections, such as, for example, round, rectangular, or square cross sections are also conceivable.

It has been demonstrated that the best knotted yarn quality is achieved with V-shaped cross sections in the spinning process.

In the case of entangling texturized yarn, the best quality is achieved with a yarn duct having a U-shaped cross section.

The invention furthermore relates to a method for manufacturing knotted yarn within a yarn duct of a nozzle, with the aid of air entanglement. Air is introduced into the yarn duct through an air bore having a longitudinal axis, which merges with the yarn duct in a merging opening at an angle of less than 90° in relation to the conveying direction. The air here is directed onto a baffle face which, on the opposite side of the merging opening of the air bore in the yarn duct, is configured so as to be perpendicular in relation to the longitudinal axis of the air bore.

The method is preferably carried out in a nozzle such as has been described above, having an air bore with an oblique longitudinal axis in relation to the conveying direction.

In a preferred method, on account of a constriction in the region of the entry opening of the yarn duct in relation to a cross section of the yarn duct in the region of the merging opening of the air bore and/or on account of a widening of the exit opening of the yarn duct in relation to a cross section of the yarn duct in the region of the merging opening of the air bore, more air dissipates via the exit opening than via the entry opening.

In an alternative method for manufacturing knotted yarn within a yarn duct of a nozzle, with the aid of air entanglement, through at least one air bore having a longitudinal axis, which merges with the yarn duct in a merging opening, air is introduced in the direction of the longitudinal axis at an angle of 90° in relation to the conveying direction of the knotted yarn, so as to be directed onto a baffle face. On account of a constriction in the region of the entry opening of the yarn duct in relation to a cross section of the yarn duct in the region of the merging opening of the air bore and/or on account of a widening of the exit opening of the yarn duct in relation to a cross section of the yarn duct in the region of the merging opening of the aire bore, more air dissipates via the exit opening than via the entry opening.

The method is preferably carried out in a nozzle such as has been described above, having an air bore with a perpendicular longitudinal axis in relation to the conveying direction.

A method in which the air is directed onto a baffle face which is disposed so as to be substantially perpendicular in relation to the longitudinal axis of the air bore is preferred.

In a further alternative method for manufacturing knotted yarn within a yarn duct of a nozzle, with the aid of air entanglement, through at least one air bore having a longitudinal axis, which merges with the yarn duct in a merging opening, air is introduced. With the aid of a step, preferably an oblique step, which is disposed between an entry opening of the yarn duct and the merging opening of the air bore on the opposite side of the air bore in the yarn duct, wherein the step leads away from the merging opening in the conveying direction, yarn is deflected around an edge of the step with air exiting from the air bore.

The method is preferably carried out in an above-described nozzle having a step.

The invention furthermore relates to the use of a nozzle for manufacturing knotted yarn, as described herein and in claims 1-12.

Further advantageous aspects of the invention are explained in the following by means of exemplary embodiments and the figures. In the drawings, in a schematic manner:

Figure 1:
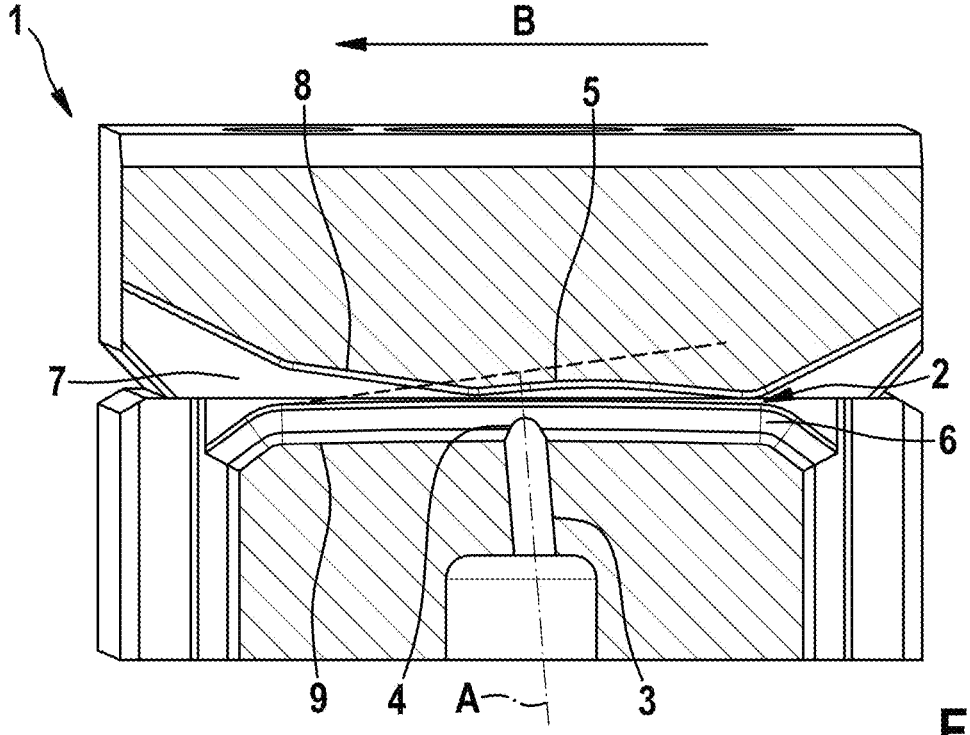
FIG. 1 shows a first embodiment of a nozzle according to the invention in the cross section.

FIG. 1 shows a nozzle 1 according to the invention, having a yarn duct 2 and an air bore 3, in the cross section. The yarn duct 2 is formed by mutually interconnected plates 8, 9. The air bore 3 has a longitudinal axis A and merges with the yarn duct 2 in a merging opening 4. In the yarn duct 2, filaments 10 (not shown, see FIG. 3, for example) are conveyed in a conveying direction B. The merging opening 4, in the conveying direction B, is located in about the centre of the nozzle 1 and is disposed at an angle of about 85° in relation to the conveying direction B. Entanglement air 13 (not shown, see FIG. 5) is introduced into the yarn duct 2 in the direction of the longitudinal axis A through the air bore 3 via the merging opening 4. The entanglement air impacts a baffle face 5 in a perpendicular manner. On account of the impact of the entanglement air 13 on the baffle face 5, two partial flow turbulences 13', 13" are formed (not shown, see FIG. 5). The perpendicular impact of the entanglement air 13 makes for the configuration of two partial flow turbulences 13', 13", which are uniform and run in opposite directions. On account of this uniformity, part of the filaments are moved in the counter-clockwise direction and the remaining filaments are moved in the clockwise direction. On account of the movement of the filaments through the partial flow turbulences 13', 13", knots are formed in the region of the merging opening, ahead of and behind the incoming entanglement air 13. On account thereof, knotted yarn 11 consisting of entangled filaments (not shown, see FIG. 3, for example) is created from the filaments 10 (non-entangled yarn). What are referred to as continuous yarns are in particular suited as filaments.

The yarn duct 2 is constricted in the region of the entry opening 6. An exit opening 7 of the yarn duct 2 is widened. The constriction and the widening are established by way of a surface profile of the cover plate 8.

On account of the oblique position of the longitudinal axis A of the air bore 3 in relation to the running direction B of the filaments, a net dissipation via the exit opening 7 of the yarn duct 2 results. This net dissipation supports conveying of the filaments 10 or of the knotted yarn 11, respectively, through the yarn duct 2. The widening of the exit opening 7 moreover leads to the turbulences being guided away from the centre, i.e. away from the yarn. The intensity of the turbulences is also reduced hereby. On account thereof, the yarn 11 is not conveyed away from the centre of the yarn duct 2.

Figure 2:
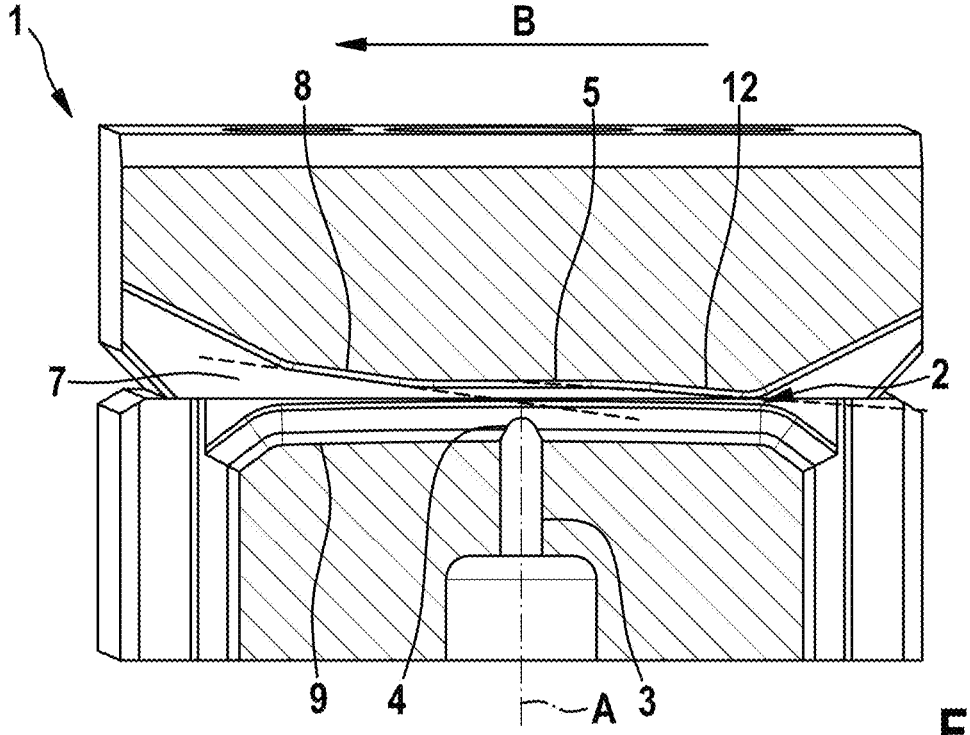
FIG. 2 shows a further embodiment of a nozzle according to the invention in the cross section.

FIG. 2 shows a nozzle 1 according to the invention, having the yarn duct 2 and the air bore 3 having the longitudinal axis A which is at 90° in relation to the conveying direction B. The yarn duct 2 is formed by the cover plate 8 and the nozzle plate 9. The yarn duct 2 is constricted in the region of an entry opening 6, and an exit opening 7 of the yarn duct 2 is widened. The constriction and the widening are formed by a surface profile of the cover plate 8. The constriction here is configured as an oblique step 12. The oblique step here leads away from the region of the entry opening 6, away from the merging opening of the air bore 3 in the conveying direction B, and thus away from the nozzle plate 9. The constriction at the entry opening 6 and the widening at the exit opening 7 lead to more air being dissipated via the exit opening 7 than via the entry opening 6. The widening is also configured as an oblique step which leads away from the nozzle plate 9 in the conveying direction B. Through the air bore 3, the entanglement air 13 is introduced into the yarn duct 2 and impacts the baffle face 5 in a perpendicular manner. The baffle face is 5 mm long, which is three times longer than a diameter of the air bore 3. Filaments 10 are introduced into the yarn duct 2 of the nozzle through the entry opening 6. On account of the entanglement air 13, the filaments 10 are guided largely along the surface of the cover plate 8. At the step 12, the filaments 10 are deflected around an edge 14 at the commencement of the step 12. On account of this deflection, the filaments 10 are flattened, such that the filaments 10 are transformed from a round shape to a tape shape. The tape shape offers the entanglement air 13 or the partial flow turbulences 13' 13" more contact surface. This leads to the filaments 10 being entangled in a consistently uniform manner and, on account thereof, consistently uniform knots are formed. A higher number of knots per metre, which are configured in a more uniform and stronger manner, results therefrom.

Figure 3:
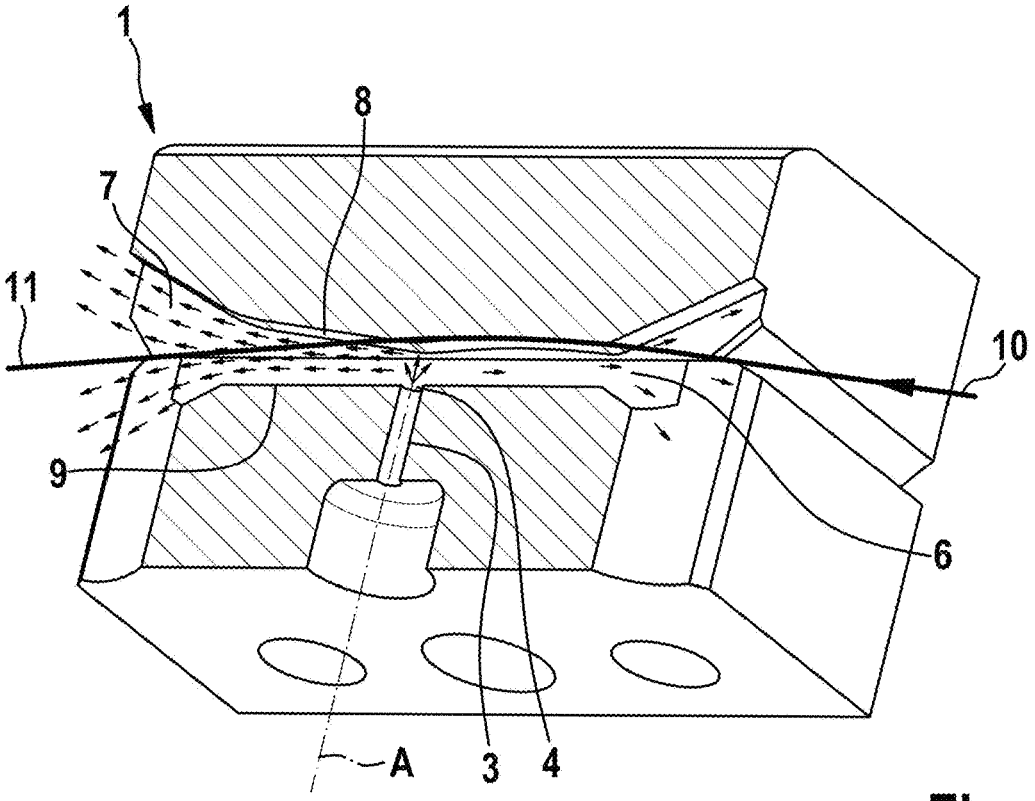
FIG. 3 shows another illustration of the nozzle from FIG. 2.

FIG. 3 shows the nozzle 1 as in FIG. 2, having the constriction in the region of the entry opening 6 and the widened exit opening 7. In a schematic manner, small arrows show the distribution of the entanglement air 13 after entering into the yarn duct 2. On account of the constriction and the widening, a net dissipation of the air via the exit opening 7 takes place. Moreover, the constriction in the region of the entry opening 6 has the advantage that a stabilizing effect on the filaments 10 is created. On account thereof, the filaments 10 oscillate less, on account of which they are conveyed through the yarn duct 2 in a pacified, consistently uniform manner. On account of this low-oscillation type of conveying, fewer deviations arise during entanglement, such that the filaments 10 are knotted in a consistently uniform manner and the number of knots per metre is increased.

Through the widening at the exit opening 7, the air turbulences are guided away at the exit opening 7 by the knotted yarn 11. On account thereof, the yarn 11 is not negatively influenced by the turbulences and is not carried out of the centre of the nozzle.

Figure 4:
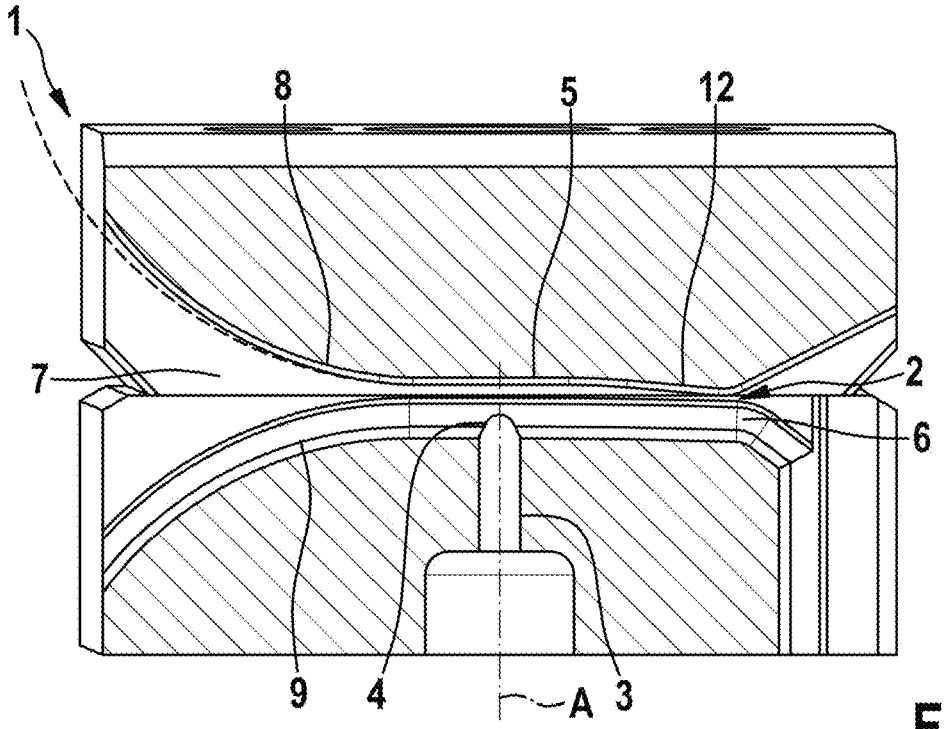
FIG. 4 shows an alternative embodiment of a nozzle according to the invention in the cross section.

FIG. 4 shows an alternative embodiment of the nozzle 1 having the widened exit opening 7. The widening is formed by both the cover plate 8 and also the nozzle plate 9. The widening in the two plates 8, 9 here is not configured as an oblique step but as surfaces of the plates 8, 9 which are curved in a convex manner in relation to the yarn duct. On account of the curved surface, in the longitudinal section, the nozzle exit looks similar to an end piece of a trumpet, as shown in FIG. 3. On account of the convex curvature, a Coandă effect arises, i.e. the air is guided away along the surface and does not interact with the filaments 10 in the centre of the yarn duct 2.

Figure 5:
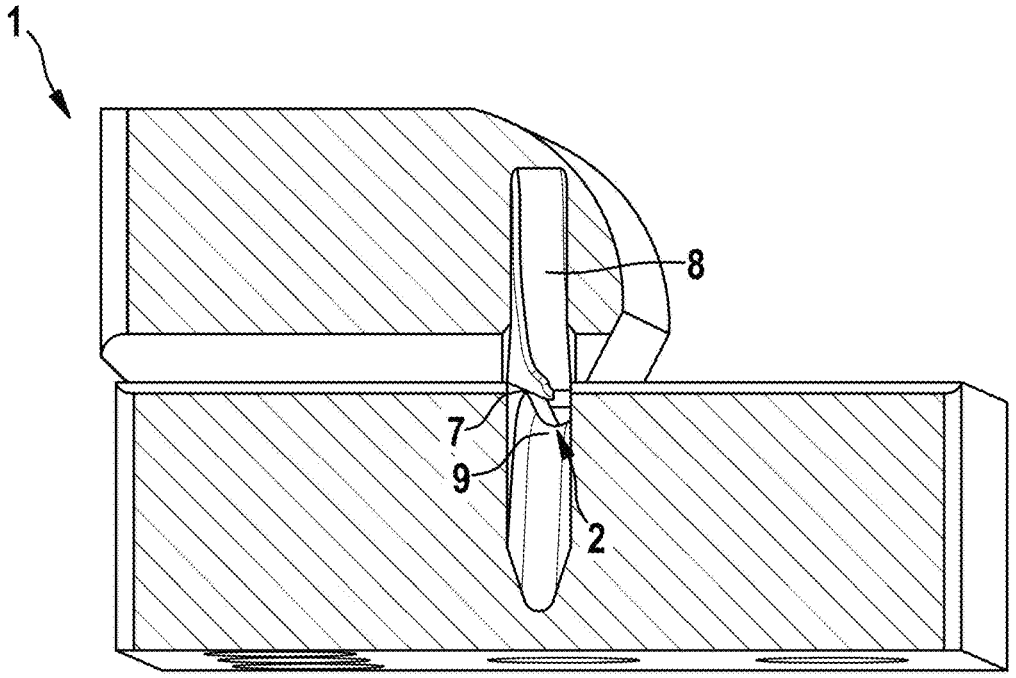
FIG. 5 shows a front view of the nozzle from FIG. 4.

FIG. 5 shows the nozzle 1 as in FIG. 4, in a front view onto the exit opening 7. The yarn duct 2 is formed by the cover plate 8 and the nozzle plate 9. The yarn duct here displays a U-shaped cross section. The nozzle plate 9 here is configured so as to converge in a substantially pointed manner, and the cover plate 8 is configured having a substantially linear surface. On account thereof, an asymmetrical, V-shaped cross section is created. Asymmetrical cross sections, such as U-shaped, V-shaped, or T-shaped cross sections, are also applicable in the case of the further nozzles 1 according to the invention. Texturized yarn is best entangled using a U-shaped cross section as in FIG. 5.

Figure 6:
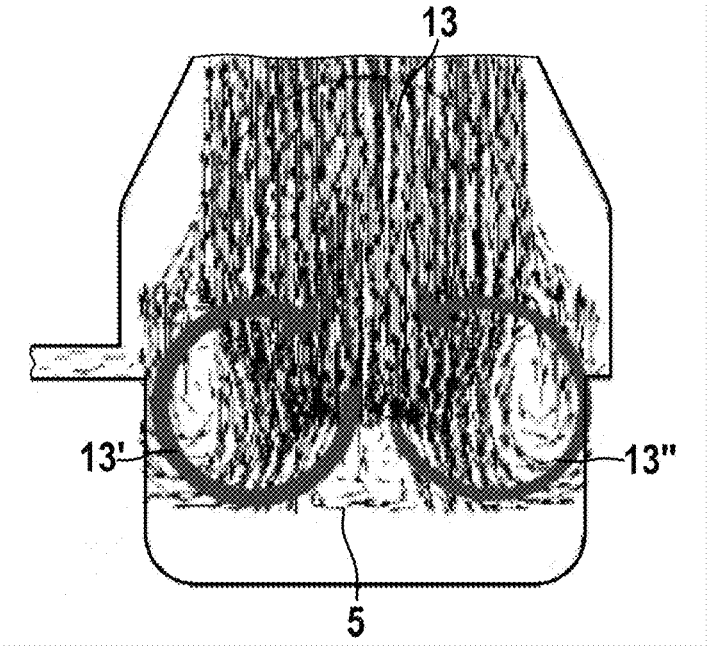
FIG. 6 shows an air stream onto a baffle face.

FIG. 6 shows a detail of the yarn duct 2 at the baffle face 5. The entanglement air 13 impacts the baffle face in a perpendicular manner. On account thereof, two uniform partial flow turbulences 13', 13" are created. Here, one partial flow turbulence 13' rotates in the clockwise direction, the second partial flow turbulence 13" rotates in the counterclockwise direction. The partial flow turbulences convey the filaments 10, on account of which the filaments 10 are also twisted in the respective direction in relation to one another. On account thereof, the filaments 10 are knotted to form knotted yarn 11. On account of the uniform configuration of the partial flow turbulences 13', 13", the filaments 10 are also knotted in a consistently uniform manner.

Figure 7:
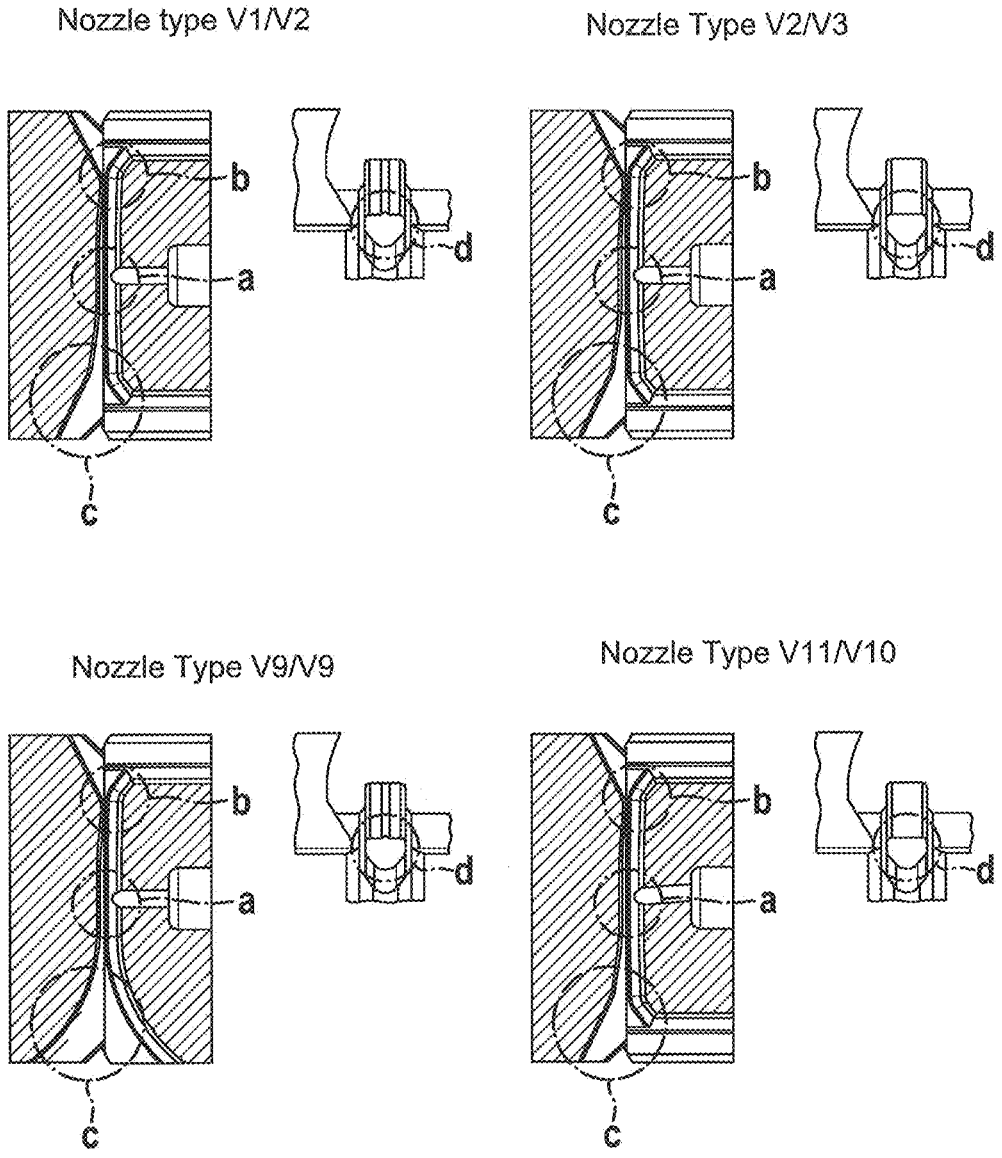
FIG. 7 shows a collection of various nozzles according to the invention in the cross section.

FIG. 7, in a schematic manner, shows four nozzles 1 according to the invention (V1/V2, V2/V3, V9/V9, V11/V10) in the cross section and in a detailed view, in the longitudinal section, at the entry opening 6. Four regions a), b), c), d) are identified in the nozzles 1. The region a) relates to a region of the air bore 3, b) relates to a region at the entry opening 6, c) relates to a region at the exit opening 7, and d) relates to a detailed view of the region of feature b) in the longitudinal section. The nozzles have in each case one yarn duct 2 having an asymmetrical cross section which is configured in a V-shape.

V1/V2 displays the following features:

a) The air bore 3 is perpendicular (90°+/−3°) in relation to the baffle face 5, and perpendicular in relation to the conveying direction of the filaments 10.

b) The increase in height at the entry opening 6 in relation to the total height of the yarn duct 2 at the merging opening 4 of the air bore 3 with the baffle face 5, as a basis, is 30%+/−25%.

The increase in height at the entry opening 6 in relation to the height of the yarn duct 2 of the cover plate 8 at the merging opening 4 of the air bore 3 with the baffle face 5, as a basis, is 60%+/−30%. The constriction in height at the entry opening 6 in relation to the total height of the yarn duct 2 at the merging opening 4 of the air bore 3 is 40%+/−30%.

c) Air is rapidly dissipated on account of two angles in the exit opening 7 of the nozzle 1. The first angle is in the range of 5-10°, and the second angle in the range of 20-35°.

d) On account of applying a centering element on the heighest point of feature b), the yarn is retained in the centre of the yarn duct 2. The centering element is configured such that a clearance has been removed in the region of the constriction on the entry opening 6. The clearance is preferably configured so as to be U-shaped, V-shaped or trapezoidal, and on the cover plate. By way of the centering element, the yarn is retained so as to be spaced apart from the cover plate, in the centre of the yarn duct 2. On account of the spacing in relation to the cover plate, the filaments 10, however, are to a lesser extent or not deflected around an edge and thus brought into a tape shape, respectively.

The nozzle V2/V3 has the same features a), b), and c) as the nozzle V1/V2. In contrast to the nozzle V2/V3, the yarn is pressed against the radius in the feature d), since no centering element which is configured as a clearance is present. On account thereof, the filaments 10 are flattened (and become tape shaped).

The nozzle V9/V9 has the same features a), b), d) as the nozzle V2/V3. In contrast to the nozzle V2/V3, the nozzle V9/V9 in the region c) has two tangential radii on the exit opening 7 of the yarn duct 2. On account of the radii, the air is rapidly dissipated. On account of the Coandă effect, the air is moreover guided along the surface of the cover plate 8, or nozzle plate 9, respectively. On account thereof, a pacified profile of the yarn 11 in the centre of the yarn duct 2 is ensured.

The nozzle V11/V10 has the same features b), c), d) as the nozzle V2/V3. In contrast to the nozzle V2/V3 (and V1/V1, V9/V9), the nozzle V11/V10 has an air bore 3 which is inclined by approximately 78° in relation to the conveying direction of the filaments 10. The baffle face 5 is diposed so as to be perpendicular in relation to the air bore 3, such that the former points in an oblique manner into the yarn duct 2. On account of this arrangement, the yarn is conveyed by the air 13 of the inclined air bore 3, on the one hand, and on account of the baffle face 5 which is perpendicular to the air bore 3, an optimal entanglement of the filaments 10 is achieved, on the other hand.

FIGS. 8-11 show test results obtained with nozzles 1 according to the invention, compared with Polyjet nozzles of the applicant, known from the prior art (HN 133, RPE). In contrast to the nozzles 1 according to the invention, Polyjet nozzles display at least one duct for introducing entanglement air and at least one duct for introducing conveying air. In the nozzle according to the invention, either both functions are assumed by the same duct, that is to say the air bore 3, and/or conveying is accomplished by a constriction in the region of the entry opening 6 and/or a widening of the exit opening 7. However, in both cases only one air bore is present.

Figure 8:
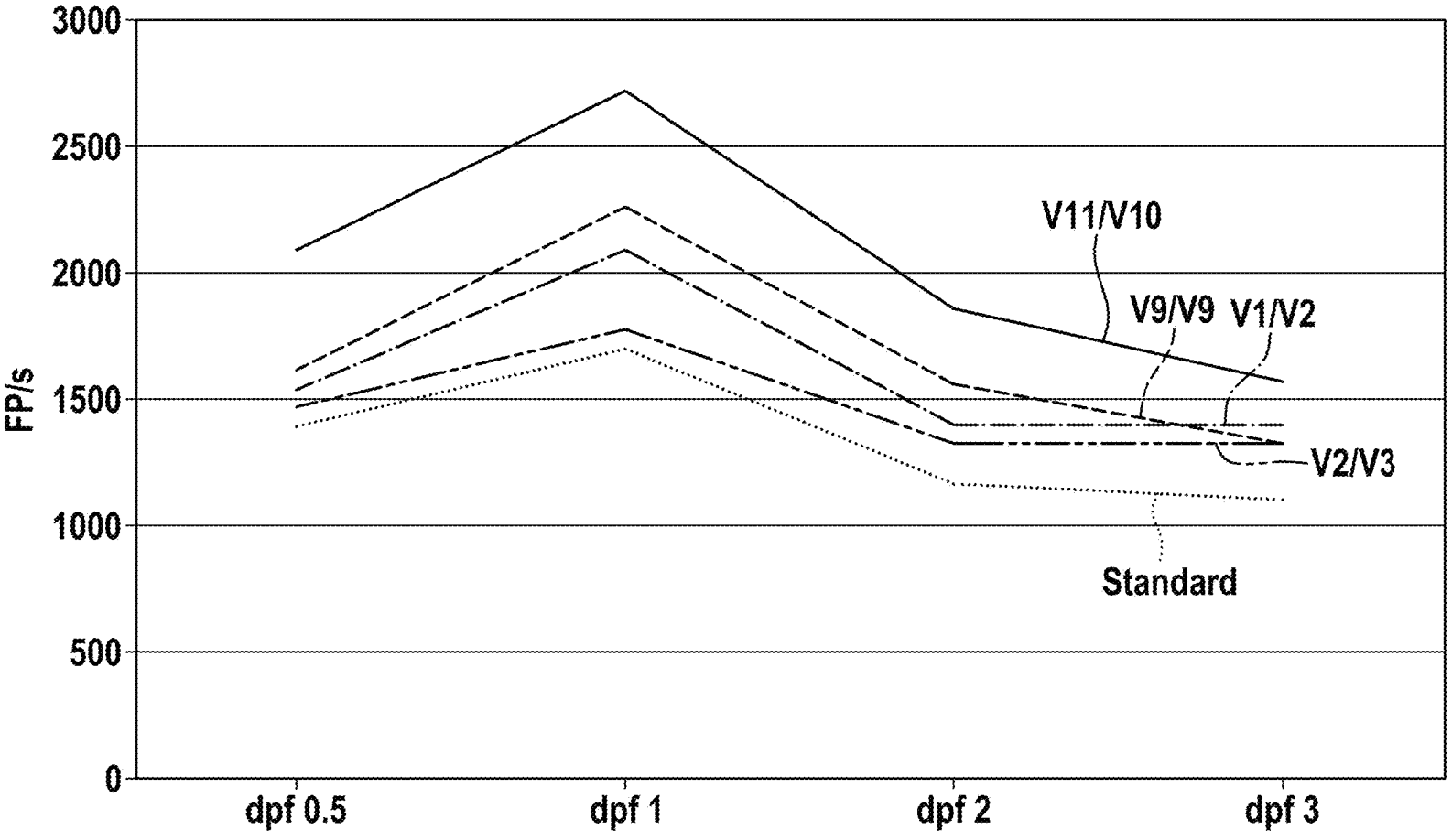
FIGS. 8-11 show comparative measurements of nozzles according to the invention with nozzles from the prior art.

FIG. 8 shows a comparative measurement in which FP/s (fixed points per second/number of knots per second) are measured in relation to dpf (Denier per filament/weight per length). In the following case, filaments from polyester having the same density were used. In the case of same density of the filaments, dpf can be assumed to be equal to a diameter of the filaments. As shown in FIG. 8, more knots per time are achieved with nozzles according to the invention in comparison to the standard nozzle known from the prior art. Here, the nozzle V11/V10 having the obliquely positioned air bore achieved the best results.

Figure 9:
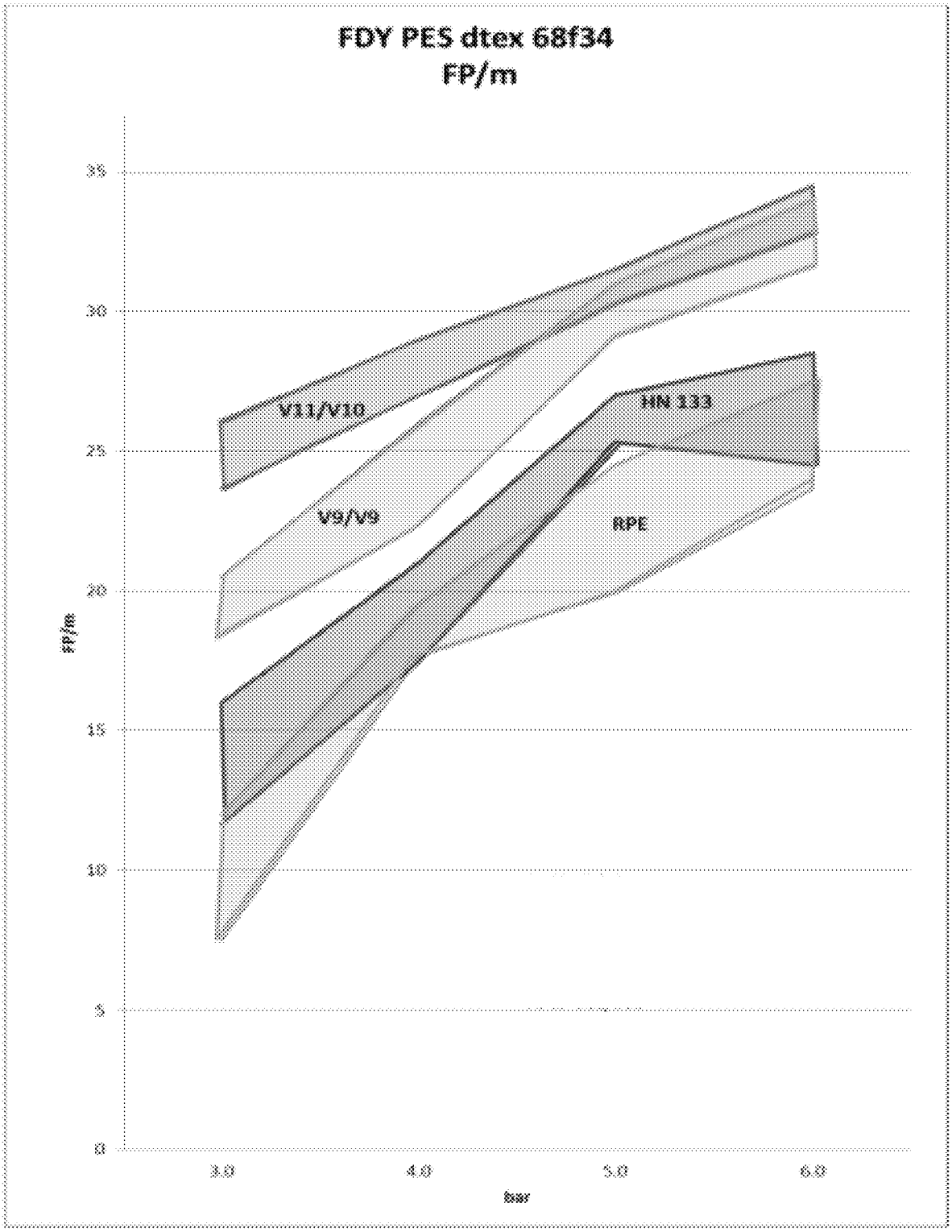
Figure 10:
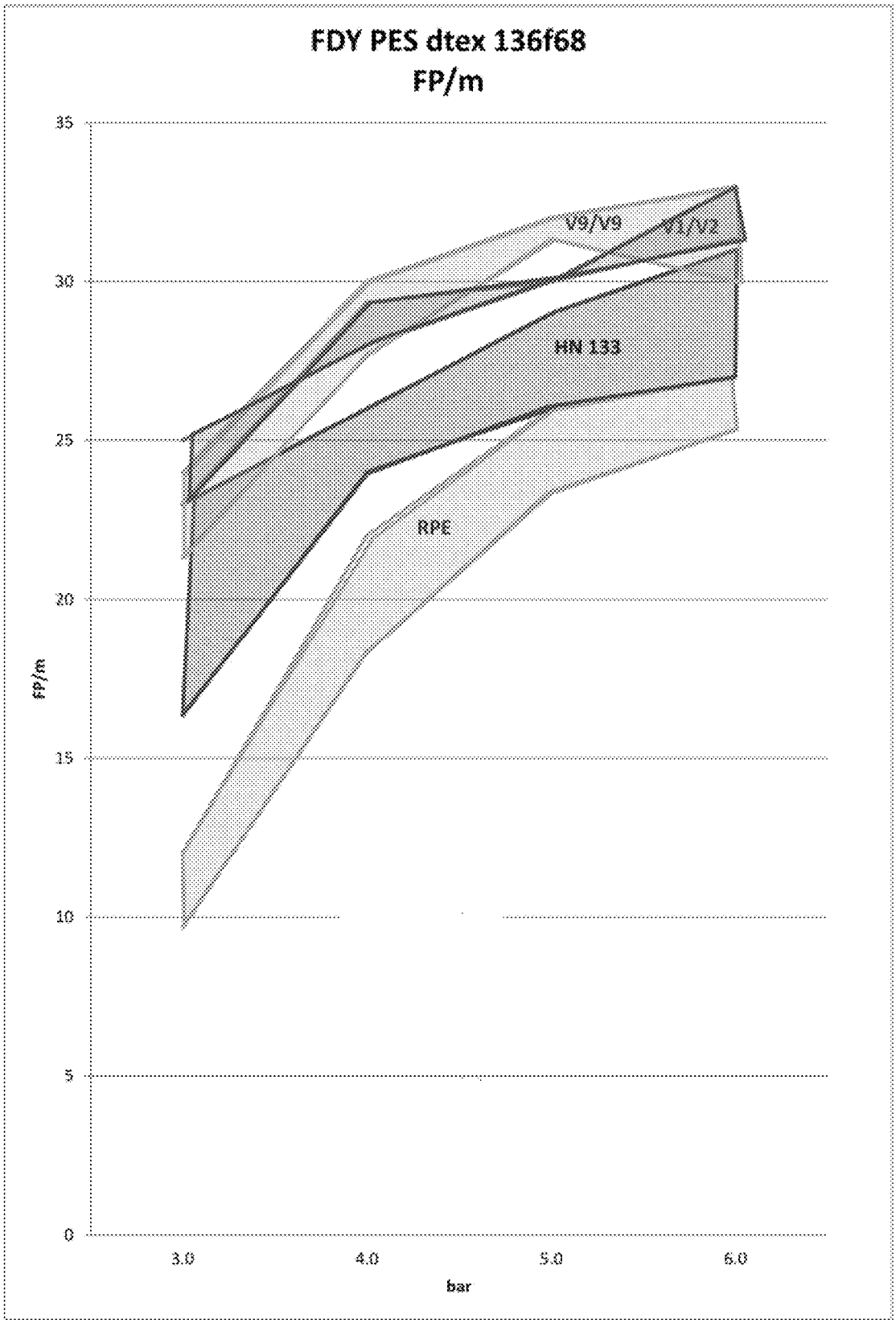
Figure 11:
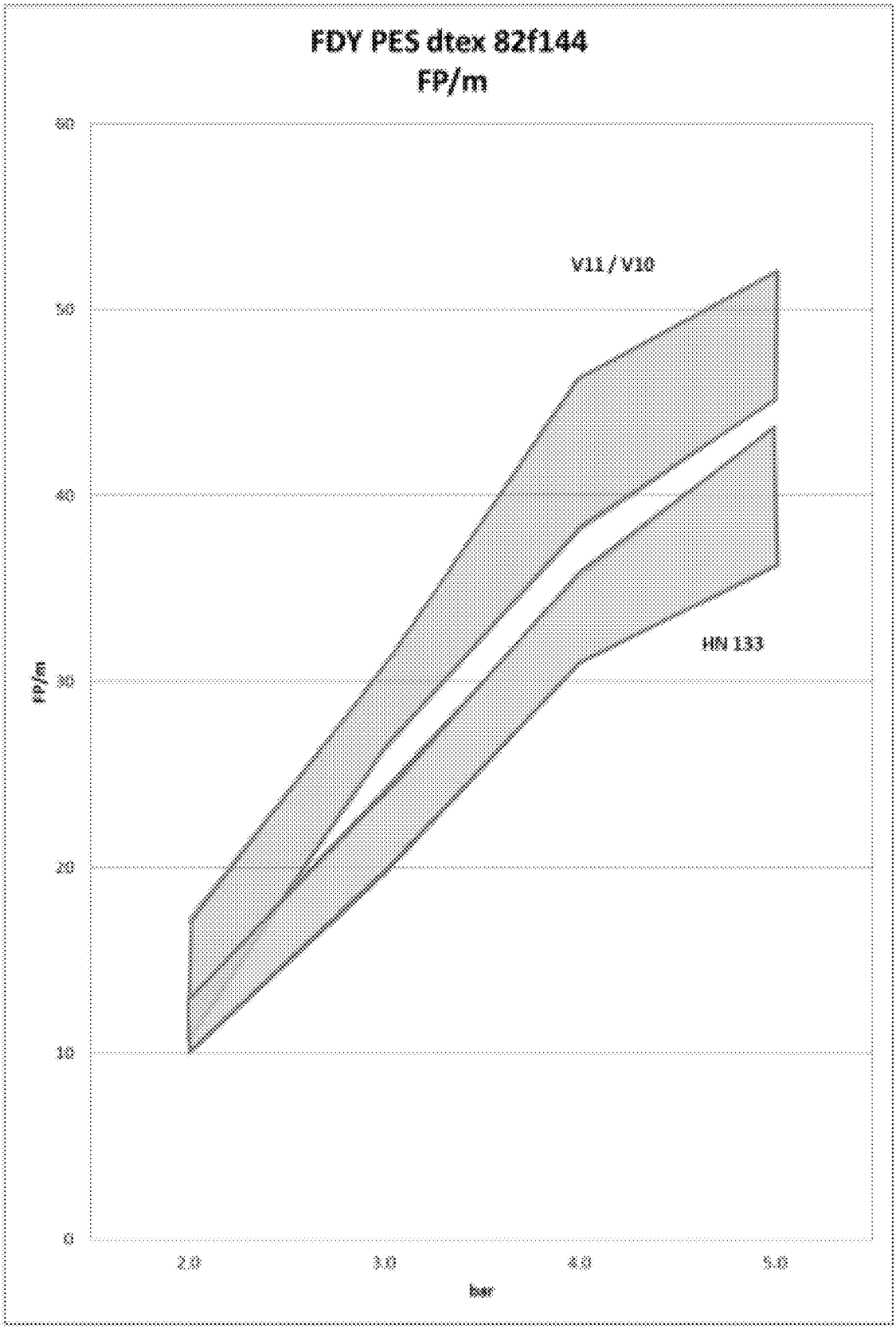

In the comparative test which is illustrated in FIGS. 9-11, the number of knots per metre (FP/m) were compared, depending on the pressure of the entanglement air in bar. Here, identical polyester filaments (PES filaments), i.e. having a consistent dpf, were used. In the case of a consistent air-bore diameter within a nozzle, the following applies: the higher the pressure, the more knots (knots/metre) are configured.

In FIG. 9, Dtex68f34 which is composed of 34 filaments and weighs 68 grams per 10,000 m was used. In the test, the nozzles V9/V9 and V11/V10 according to the invention were compared to the standard nozzles HN 133, and RPE. Here, the number of knots per meter (FP/m) were compared, depending on the pressure of the entanglement air in bar. In the diagram, the lower border of the area of the respective nozzle shows the number of firm knots. The upper border shows the total number of knots, i.e. firm and soft knots combined.

The firmness of the knots is measured by stressing the knotted yarn 11 with 0.3 cN/dtex, 0.5 cN/dtex, and 0.7 cN/dtex. After each stress cycle, the loss of knots in comparison with the unstressed knotted yarn 11 is represented in a percentage. Knots which open up at up to 0.3 cN/dtex are considered to be soft. Knots which remain in the yarn after a stress cycle of at least 0.5 cN/dtex are considered to be firm. Moreover, the knots are optically judged. The longer a knot, the more stable, i.e. the harder it is judged to be.

In this manner, the nozzle V9/V9 at 3 bar achieves 18 firm knots and a total of 21 knots per metre, for example. The smaller the distance between the lower and the upper border of the area, the more uniform and firmer the knots. Nozzles according to the invention not only show more knots per metre, but in the case of many pressures also the more uniform and firmer knots. The nozzles according to the invention, in their configuration of uniform firm knots, depend to a lesser extent on a specific pressure than the nozzles of the prior art. On account thereof, the nozzles may be used for various entanglement processes. The pressure and thus the air consumption may be reduced without any significant drop in the number of knots.

FIGS. 10 and 11 show the same measurements as in FIG. 9, wherein another thread (and other nozzles) were used, as compared with FIG. 9.

In FIG. 10, the nozzles V1/V2 and V9/V9 were compared with the two standard nozzles from FIG. 9. A thread from 136 polyester filaments, having a weight of 136 g/10,000 m (FDY PES 136f68) was used. Using the nozzles according to the invention, in the case of most pressures more, and above all firm knots are more regularly achieved than with the nozzles from the prior art.

In FIG. 11, the nozzle V11/V10 was compared with the nozzle HN 133 from the prior art. A thread from 144 polyester filaments, having a weight of 82 g/10,000 m (FDY PES 82f144) was used. Using the nozzle V11/V10 according to the invention, more knots are achieved than with the known nozzle.

The tests illustrated in FIGS. 9-11 demonstrate that the nozzles according to the invention show better results than the nozzles from the prior art in the case of the most varied yarns.

Figure 12:
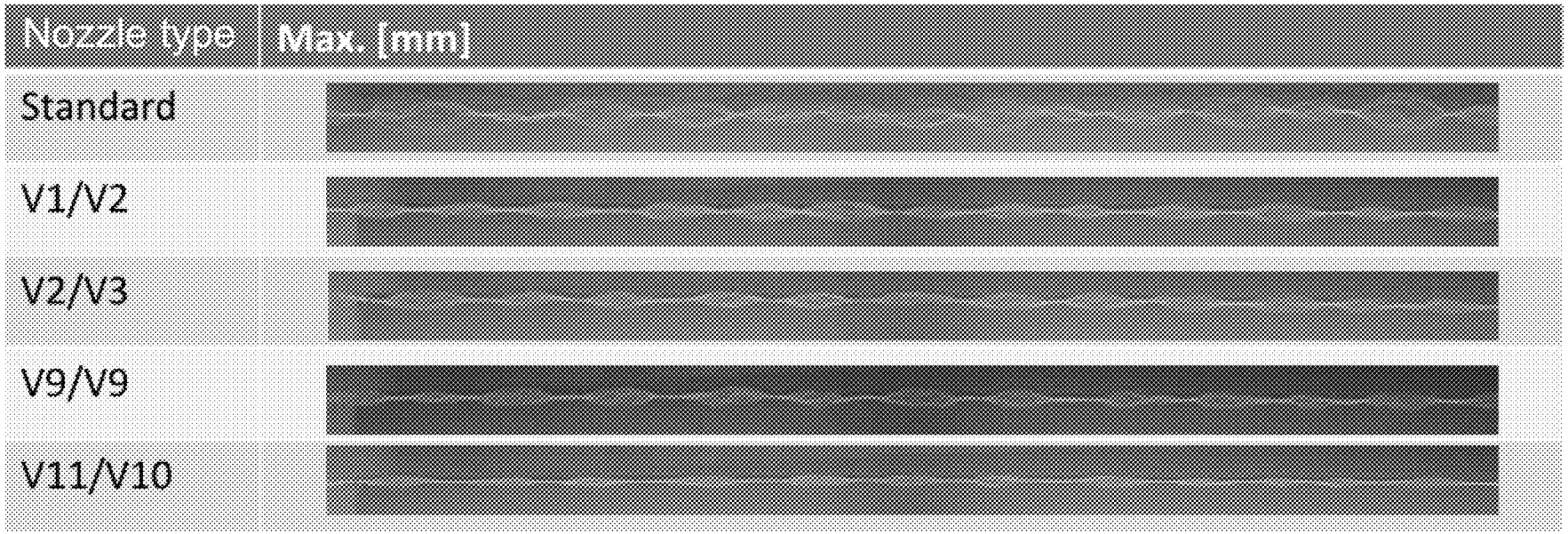
FIG. 12 shows properties of knotted yarn from nozzles of FIG. 7 in comparison with a nozzle from the prior art.

FIG. 12 shows knotted yarn which was manufactured using various nozzles 1 according to the invention (V1/V2, V2/V3, V9/V9, V11/V10) in comparison with knotted yarn manufactured using a standard nozzle (HN133A/CN14) from the prior art.

Knotted yarn manufactured using the standard nozzle shows open spots and weak (short) knots. Moreover, the spacing between knots is non-uniform. In contrast, the nozzles 1 according to the invention show uniform long knots. Here, knotted yarn 11 of the nozzle V11/V10 displays a very high number of knots and the hardest knots. The properties of the yarns are listed in the following table.

TABLE 1

| Nozzle type | No. of knots | Knot length | Stability | Knot spacing |
|---|---|---|---|---|
| Standard HN133A/CN14 | Average | Average | Average | Non-uniform |
| V1/V2 | High | Average | Average | Uniform |
| V2/V3 | High | Average | Average | Uniform |
| V9/V9 | Very high | Short | Soft | Uniform |
| V11/V10 | Very high | Long | Hard | Uniform |

The invention claimed is:

1. A nozzle for manufacturing knotted yarn, having a yarn duct in which knots are producible with aid of air entanglement, and having at least one air bore having a longitudinal axis (A), a cover plate and a nozzle plate define the yarn duct, wherein said air bore merges with the yarn duct in a merging opening and air is introducible into the yarn duct through the air bore, the longitudinal axis (A) of the air bore is disposed at an angle of 90° in relation to a conveying direction (B) of a yarn, and the cover plate has a non-planar profile such that at least one of:

a region of the cover plate is angled in the conveying direction toward the nozzle plate at an entry opening of the yarn duct and forms a constriction in the yarn duct in relation to a cross section of the yarn duct in a region of the merging opening of the air bore, and/or a region of the cover plate is angled in the conveying direction away from the nozzle plate at an exit opening of the yarn duct and forms a widening in the yarn duct in relation to the cross section of the yarn duct, in a region of the merging opening of the air bore, and the cover plate has a baffle face which faces the nozzle plate and is configured on an opposite side of the yarn duct from the merging opening of the air bore in the yarn duct such that air flowing along the longitudinal axis of the air bore is directed onto the baffle face and a larger net amount of air dissipates via the exit opening than via the entry opening.

2. The nozzle according to claim 1, wherein the baffle face is configured so as to be substantially perpendicular in relation to the longitudinal axis (A) of the air bore.

3. The nozzle according to claim 1, wherein the nozzle plate and the cover plate are releasably connectable to one another.

4. The nozzle according to claim 1, wherein the baffle face, in the conveying direction (B), has a length of 2-4 times a diameter of the air bore.

5. The nozzle according to claim 4, wherein the baffle face has a length of 4-6 mm.

6. The nozzle according to claim 1, wherein at least one of the constriction in the region of the entry opening, and the widening in a region of the exit opening is formed by a surface profile of a cover plate of the yarn duct.

7. The nozzle according to claim 1, wherein at least one of the constriction in the region of the entry opening and the widening in the region of the exit opening is formed by a surface profile of a cover plate and of a nozzle plate.

8. The nozzle according to claim 1, wherein the yarn duct displays an asymmetrical cross section.

9. The nozzle according to claim 8, wherein the asymmetrical cross section is one of a substantially U-shaped, V-shaped, or T-shaped cross section.

10. A nozzle for manufacturing knotted yarn, having a yarn duct in which knots are producible with aid of air entanglement, and having at least one air bore having a longitudinal axis (A), wherein said air bore merges with the yarn duct in a merging opening and air is introducible into the yarn duct through the air bore, a step is configured between an entry opening of the yarn duct and the merging opening of the air bore, on a side of the yarn duct which is opposite the air bore, and the step leads away from the merging opening, in a conveying direction (B), such that yarn is deflectable around an edge of the step and that filaments of the yarn are transformed from a round shape to a tape shape or a shape similar to that of a tape, wherein a cross section of the yarn duct at an end of the step, in the conveying direction of the yarn, is larger than the cross section of the yarn duct at a commencement of the step, or the step is configured as a protrusion which is radially oriented in an inward manner such that the filaments are deflected on the protrusion and thereby flattened.

11. The nozzle according to claim 10, wherein the step is configured at the entry opening of the yarn duct and runs at an angle of approximately 2-6°.

12. The nozzle according to claim 11, wherein the step run at an angle of 4°.

13. The nozzle according to claim 10, wherein the step is configured at the entry opening of the yarn duct and runs at an angle of approximately 2-6°.

14. The nozzle according to claim 13, wherein the step runs at an angle of approximately 4°.

15. The nozzle according to claim 10, wherein the yarn duct displays an asymmetrical cross section.

16. The nozzle according to claim 15, wherein the asymmetrical cross section is one of a substantially U-shaped, V-shaped, or T-shaped cross section.

17. The nozzle according to claim 10, wherein said step is an oblique step.

18. A method for manufacturing knotted yarn within a yarn duct of a nozzle having a cover plate and a nozzle plate which define the yarn duct, with the aid of air entanglement, wherein, through at least one air bore having a longitudinal axis (A), air is introduced in a direction of the longitudinal axis (A) at an angle of 90° in relation to a conveying direction (B) of a yarn, so as to be directed onto a baffle face, said air bore merges with the yarn duct in a region of a merging opening, wherein, on account of the cover plate having a non-planar profile and at least one of:

the cover plate forming a constriction in the yarn duct in a region of an entry opening of the yarn duct in relation to a cross section of the yarn duct in the region of the merging opening of the air bore and the cover plate forming a widening in the yarn duct of an exit opening of the yarn duct in relation to a cross section of the yarn duct in the region of the merging opening of the air bore, a larger net amount of air dissipates via the exit opening than via the entry opening.

19. The method according to claim 18, wherein the air is directed onto the baffle face which is disposed so as to be substantially perpendicular in relation to the longitudinal axis (A) of the air bore.

20. A method for manufacturing knotted yarn, within a yarn duct of a nozzle, with aid of air entanglement, wherein, through at least one air bore having a longitudinal axis (A), air is introduced, the air bore merges with the yarn duct, wherein with the aid of a step, which is configured between an entry opening of the yarn duct and a merging opening of the air bore in the yarn duct on an opposite side of the yarn duct than the air bore, wherein the step leads away from the merging opening in a conveying direction (B), such that yarn is deflected around an edge of the step on account of air from the air bore, such that filaments of the yarn are transformed from a round shape to a tape shape or a shape similar to that of a tape, wherein a cross section of the yarn duct at an end of the step, in the conveying direction of the yarn, is larger than the cross section of the yarn duct at a commencement of the step, or the step is configured as a protrusion which is radially oriented in an inward manner such that the filaments are deflected on the protrusion and thereby flattened.

21. The method according to claim 20, wherein said step is an oblique step.

* * * * *